US008315548B2

(12) United States Patent
Gayne et al.

(10) Patent No.: US 8,315,548 B2
(45) Date of Patent: Nov. 20, 2012

(54) CLEANER ASSEMBLY FOR MOVING AND STORING WASTE TONER IN AN IMAGING APPARATUS USING AN AUGER DISPOSED WITHIN A TUBE

(75) Inventors: Jarrett Clark Gayne, Lexington, KY (US); Nicholas Fenley Gibson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 244 days.

(21) Appl. No.: 12/709,767

(22) Filed: Feb. 22, 2010

(65) Prior Publication Data

US 2011/0206433 A1 Aug. 25, 2011

(51) Int. Cl.
*G03G 21/00* (2006.01)

(52) U.S. Cl. ..... 399/358

(58) Field of Classification Search ..... 399/358
See application file for complete search history.

(56) References Cited

U.S. PATENT DOCUMENTS

| | | | | |
|---|---|---|---|---|
| 5,708,952 | A * | 1/1998 | Taniguchi et al. | 399/358 |
| 5,933,696 | A * | 8/1999 | Howard et al. | 399/360 |
| 7,167,672 | B2 * | 1/2007 | Stafford et al. | 399/360 |
| 2010/0232852 | A1 * | 9/2010 | Noso | 399/358 |

FOREIGN PATENT DOCUMENTS

| | | | |
|---|---|---|---|
| JP | 01136182 | A * | 5/1989 |
| JP | 05204281 | A * | 8/1993 |

* cited by examiner

*Primary Examiner* — Quana M Grainger

(57) ABSTRACT

A cleaner assembly within a printer cartridge is provided that moves waste toner from photoconductive drum and stores it in a waste toner storage container. The cleaner assembly includes an auger, a drive shaft, and the waste toner storage container that includes a tube with plurality of perforations. The tube has a first end and a second end, wherein the first end is attached to an inlet to receive the waste toner and the second end extends to a point vertically above the inlet. The auger extends into inside of the waste toner storage container through the inlet and follows passage formed by the tube inside the waste toner storage container. The perforations in the tube allow the waste toner to move from inside the tube to the waste toner storage container, thereby resulting in maximum utilization of the space inside the inside the waste toner storage container.

14 Claims, 11 Drawing Sheets

CLEANER ASSEMBLY FOR MOVING AND STORING WASTE TONER IN AN IMAGING APPARATUS USING AN AUGER DISPOSED WITHIN A TUBE

BACKGROUND

1. Field of the Invention

The present invention relates generally to an imaging apparatus, and particularly to a cleaner assembly that includes an auger, a drive shaft, and a waste toner storage container for moving and storing waste toner within a printer cartridge.

2. Description of the Related Art

In the electro photography process, toner is transferred from a developer roll to a photoconductive drum and then to an intermediate transfer belt. When the toner has poor transfer characteristics, the toner is not transferred from the photoconductive drum to the intermediate transfer belt and remains on the photoconductive drum. The toner that remains on the photoconductive drum is referred to as waste toner. It is desirable to remove the waste toner from the photoconductive drum. One way to remove the waste toner from the photoconductive drum is to use a cleaner blade. While the waste toner is being removed, the waste toner falls into a channel behind the photoconductive drum. However, the capacity of the channel may not be enough to accommodate the amount of the waste toner that is produced during life of the printer cartridge. This creates a need for a mechanism that moves the waste toner from the channel and stores the waste toner in a different storage area of the printer cartridge where more space is available.

Generally, an auger that is housed in the channel is utilized for transferring the waste toner from the channel to a storage area in the printer cartridge. The auger is driven by a photoconductive drum drive and keeps rotating during the printing process to prevent accumulation of the waste toner in the channel behind the photoconductive drum. An end of the channel opens into the storage area that is generally referred to as a waste toner storage container. FIG. 1 illustrates a cross sectional view of the auger/waste toner storage container design according to a prior art system explaining the mechanism to move the waste toner into the waste toner storage container. After the waste toner is removed from the photoconductive drum, the waste toner is guided into a channel 20. During the printing process, a drive gear 24 attached to an auger 22 receives a driving force due to which the auger 22 is turned in a direction that pushes the waste toner towards the waste toner storage container 28 (movement of the waste toner shown by arrow 26). This creates sufficient room inside the channel 20 to receive a fresh supply of the waste toner from the photoconductive drum.

Current design architecture oftentimes requires that the waste toner enters into the waste toner storage container 28 from a location that is closer to the bottom of the waste toner storage container. The auger 22 is straight and terminates just inside the waste toner storage container 28. The auger 22 can push the waste toner only along its axis, so the waste toner gets pushed straight into the waste toner storage container 28 instead of being directed towards the top of the waste toner storage container 28. The auger 22 is therefore required to push an ever increasing amount of the waste toner up through the waste toner storage container 28 in order to fill it entirely. Such design of the waste toner storage container 28 and location of the auger 22 builds up unwanted pressure around end of the auger 22.

Further, poor toner flow characteristics pose another problem. When a portion of the waste toner storage container 28 is filled up to height of the auger 22, the waste toner compacts around the auger 22 instead of flowing into areas of lower pressure, i.e., a portion of the waste toner storage container that is at a height above the location of the auger. As discussed, the auger 22 can only force toner in its axial direction, so the auger 22 forces the waste toner straight into the backside of waste toner storage container 28. This results in the waste toner being densely compacted around the auger 22 even though the waste toner storage container 28 is not fully filled.

As pressure around the auger 22 increases, torque on the auger 22 also increases. The pressurized waste toner creates a resistance in the rotation of the auger 22 that increases the stress on drive components of the auger 22. This causes gear teeth on the drive gear 24 to shear or slip over one another. This failure of the drive components may occur even though the waste toner storage container 28 is not fully filled. Additionally, the torque continuously changes through the life of the printer cartridge as the auger 22 is required to force the waste toner up through highly compacted layers of the waste toner. Even before the auger 22 fails, this continual increase in the torque during the life of printer cartridge results in noise that is undesirable to a user. The noise results from the auger 22 being loaded to a point that the auger 22 begins to rub against the channel 20, even though the printer cartridge is still fully operable.

Thus, there is a need to improve the auger/waste toner storage container design. It is desired to utilize substantially all the available space inside the waste toner storage container. By filling substantially all of available space, one may more efficiently utilize the waste toner storage container and further decrease the likelihood of the printer cartridge failure as discussed above. It is further desired to create an auger scheme whereby the torque on the auger remains relatively low during the life of the printer cartridge so that the noise concerns are more adequately addressed.

SUMMARY OF THE INVENTION

In accordance with an exemplary embodiment of the present invention, there is disclosed a cleaner assembly for moving waste toner within a printer cartridge that includes an auger having a helical configuration and a waste toner storage container having an inlet and a tube mounted within the waste storage container. The tube may include a first end coupled to the inlet and a second end disposed above the first end in an upper portion of the waste storage container. At least a portion of the auger is disposed within the tube. In this way, waste toner moved by the auger is moved within the tube for subsequent storage within the waste storage container.

Further, the tube may include one or more perforations defined along a length of the tube for allowing the waste toner to exit the tube. Placement of the one or more perforations on the tube allows for a more even distribution of waste toner throughout the waste storage container.

Additional features and advantages of the invention will be set forth in the detailed description that follows, and in part will be readily apparent to those skilled in the art from that description or recognized by practicing the invention as described herein, including the detailed description that follows, the claims, as well as the appended drawings.

It is to be understood that both the foregoing general description and the following detailed description of the present embodiments of the invention and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
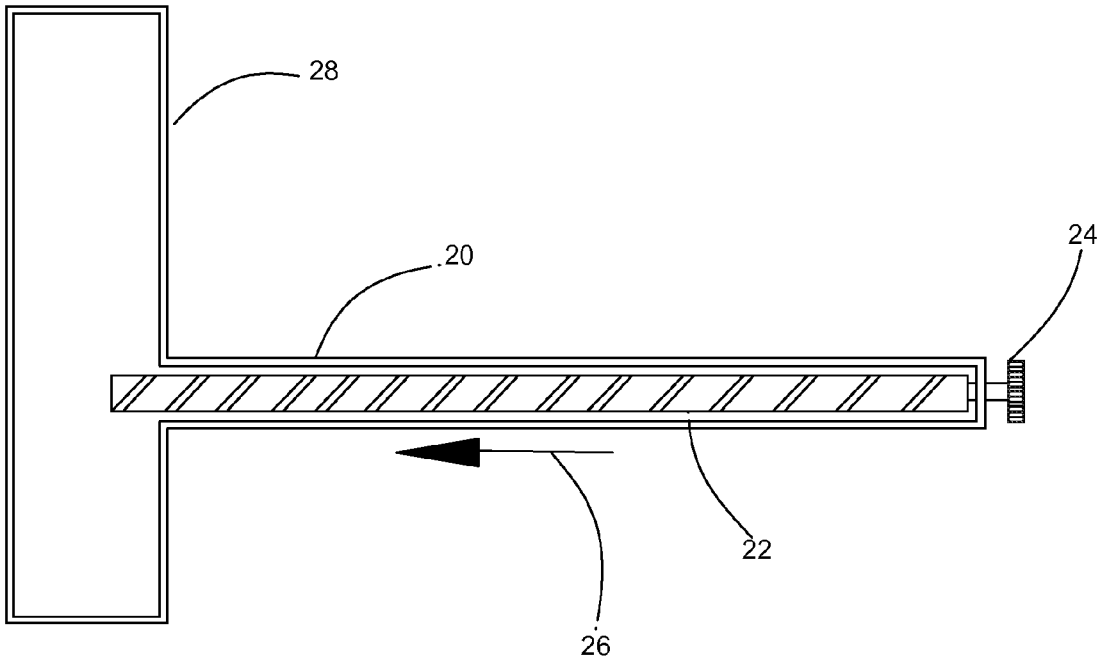
FIG. 1 (PRIOR ART)
FIG. 1 is a cross sectional view of an auger and waste toner storage container design according to a prior system.

Reference will now be made in detail to the exemplary embodiment(s) of the invention as illustrated in the accompanying drawings. Whenever possible, the same reference numerals will be used throughout the drawings to refer to the same or like parts.

Figure 2:
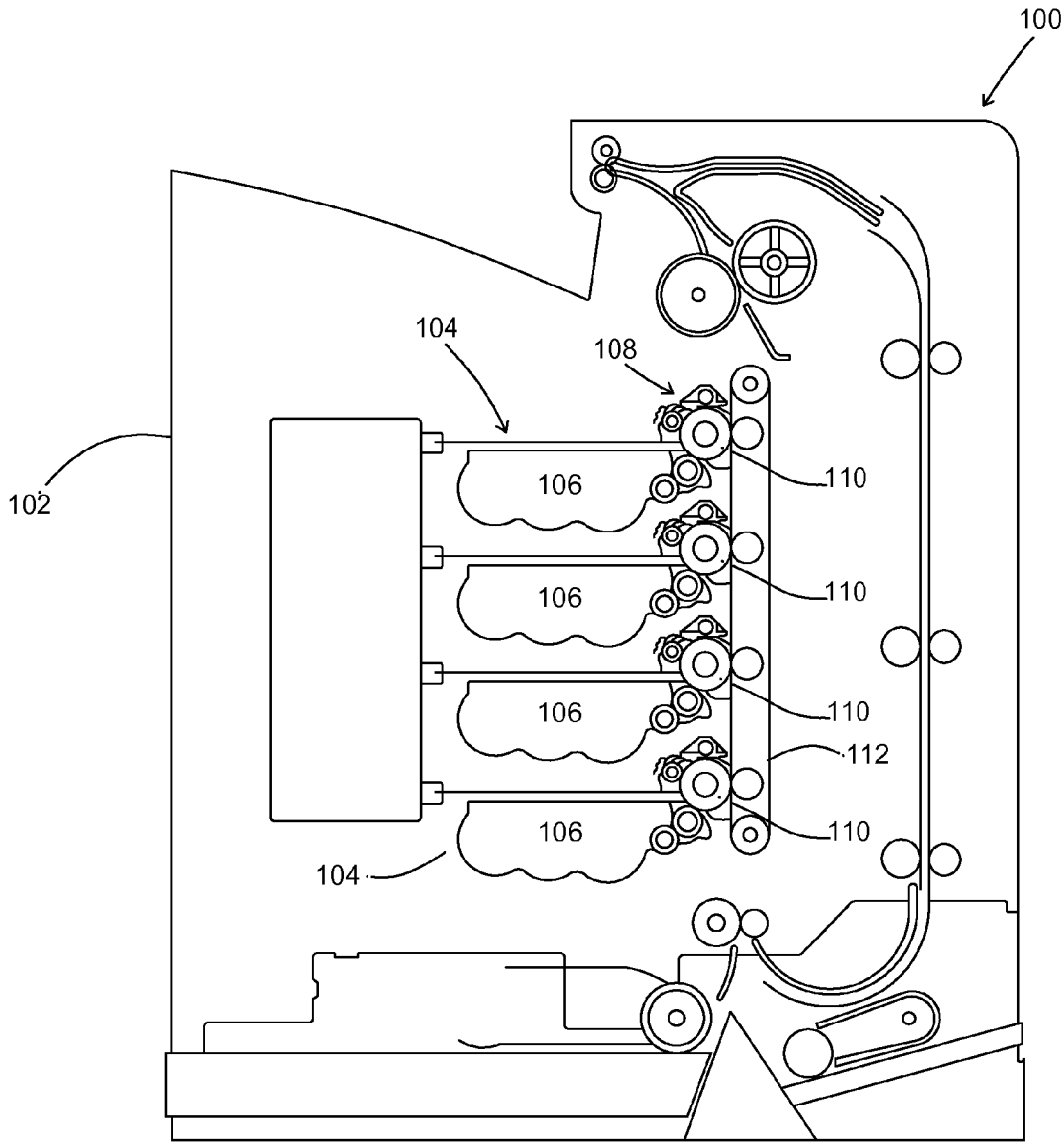
FIG. 2 illustrates general elements of one embodiment of an imaging apparatus according to the present invention.

FIG. 2 illustrates general elements of one embodiment of an imaging apparatus, such as a laser printer, according to the present invention. The imaging apparatus 100 includes a main body 102 with one or more replaceable image forming units 104. The imaging apparatus 100 typically includes four image forming units 104 for printing with cyan, magenta, yellow, and black toner to produce a four-color image on a media sheet. In this embodiment, each image forming unit 104 includes a developer section 106 and a photoconductive section 108. Developer section 106 may form a toner cartridge and be separately replaceable relative to photoconductive section 108. Toner is stored in the developer section 106 and is transferred to a photoconductive member 110 that is positioned within the photoconductive section 108. Image formed by the toner on the photoconductive member 110 is then transferred to the media sheet which is moved relative to image forming units along a transport belt 112. Alternatively, the image formed by the toner on the photoconductive member 110 is transferred to the media sheet via an intermediate transfer member or belt as part of a two step image transfer operation. After the image forming process, toner that remains on the photoconductive member 110 is moved from the photoconductive section 108 through a waste toner removal system as shown in FIG. 3.

Figure 3:
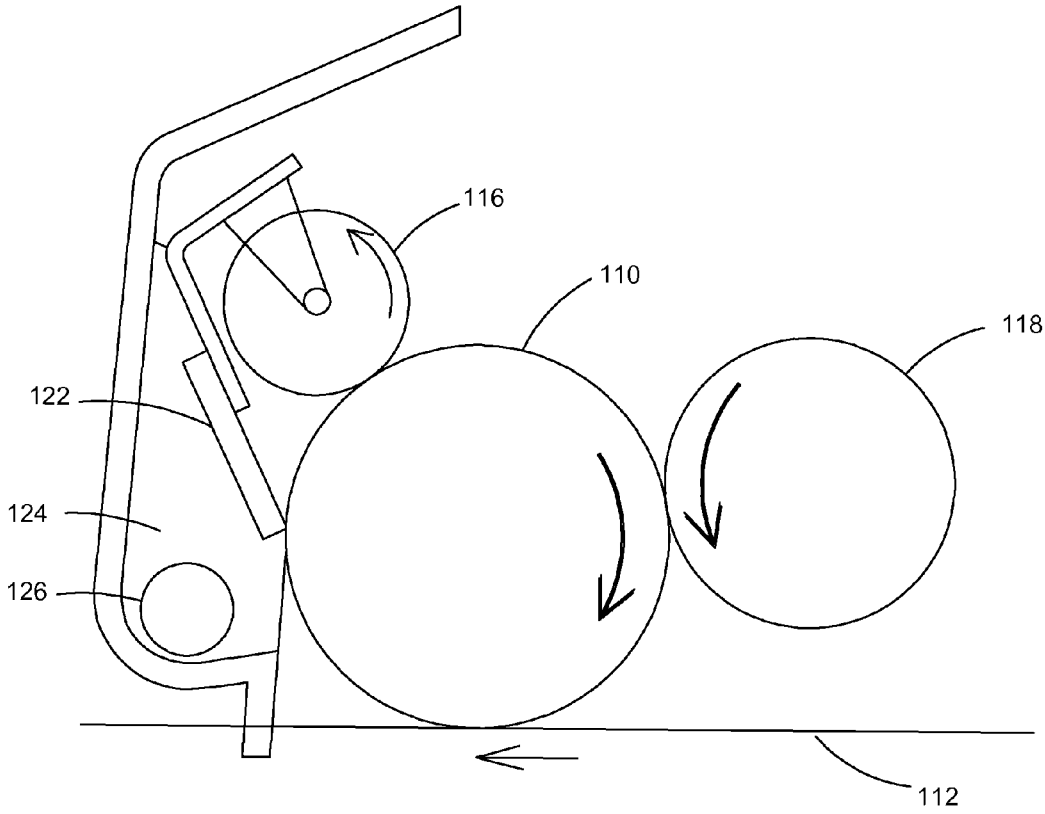
FIG. 3 is a cross-sectional view of a waste toner removal system and photoconductive drum of the imaging apparatus of FIG. 2.

FIG. 3 illustrates the waste toner removal system in association with photoconductive member 110. A charge roll 116 and a developer roll 118 of photoconductive section 108 are also shown. Waste toner remaining on photoconductive member 110 following image transfer is removed by a cleaner blade 122 or in the alternative, the waste toner may be removed by a brush or other means well known in the art. The removed waste toner is collected in a channel 124. An auger 126 moves the waste toner from the channel 124 to a waste toner storage container 140 (FIG. 5).

Figure 4:
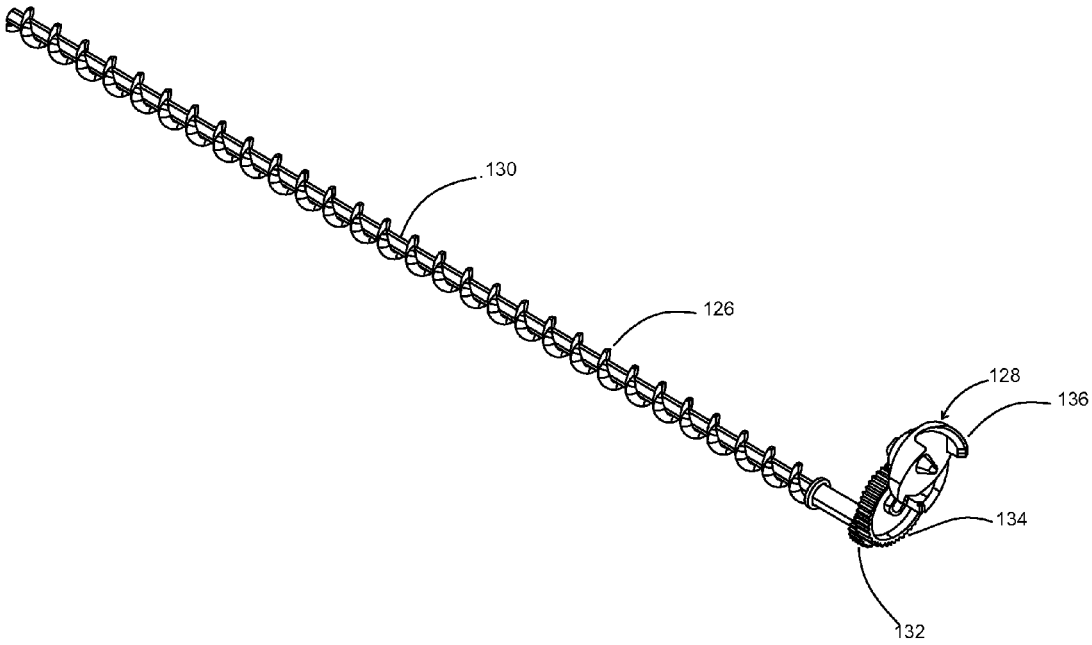
FIG. 4 is a perspective view of an auger, drive shaft and drive mechanism of the waste toner removal system of FIG. 3.

FIG. 4 illustrates a drive mechanism 128 for operating auger 126 according to an exemplary embodiment of the present invention. The auger 126 has a helical configuration and is wrapped around a drive shaft 130. Drive mechanism 128 is operatively coupled to the drive shaft 130. The drive mechanism 128 includes a drive gear 132, an idler gear 134, and a photoconductive member drive 136. The idler gear 134 connects the drive gear 132 and the photoconductive member drive 136. The drive gear 132 is directly connected to the drive shaft 130. When the drive mechanism 128 rotates the drive shaft 130, the auger 126 also rotates, causing the remaining waste toner in the channel 124 (FIG. 3) to move into the waste toner storage container 140 (FIG. 5). In one embodiment, drive shaft 130 is made from plastic and the auger 126 is made from metal wire. The metal wire auger 126 can operate while conforming to a bend as high as 90° or more, as long as the bend is gradual. In one of the embodiments, the auger 126 is made from either a flat or a round metal wire and closely resembles a conventional compression spring.

Figure 5:
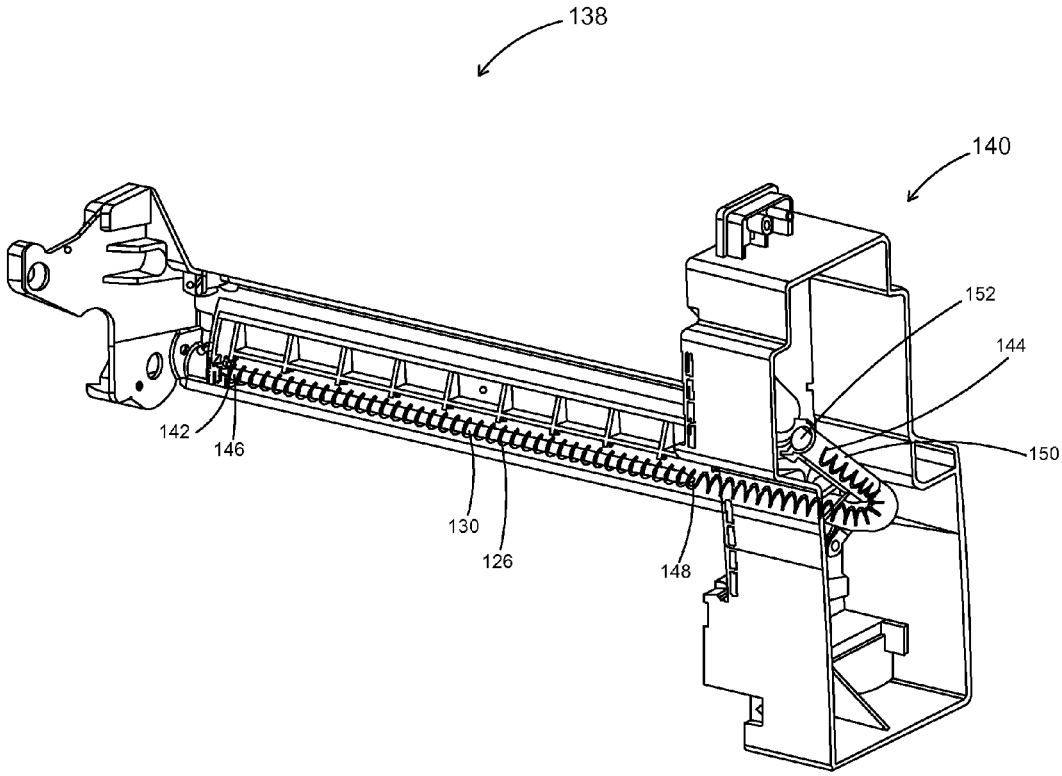
FIG. 5 is a perspective view of a cleaner assembly according to an exemplary embodiment of the present invention.
Figure 6:
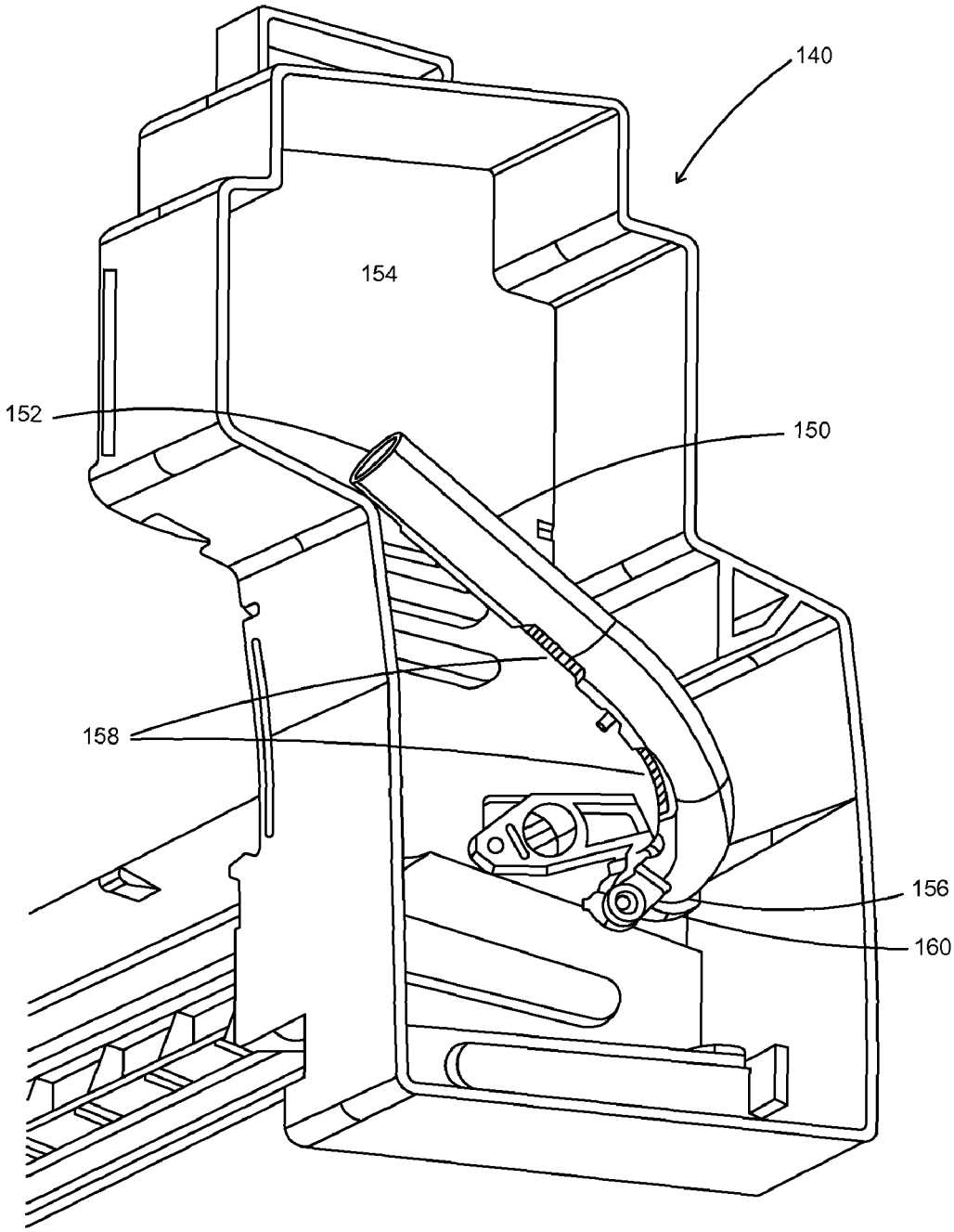
FIG. 6 is a perspective view of a waste toner storage container of FIG. 5.

FIG. 5 illustrates elements of an exemplary embodiment of the cleaner assembly 138 according to the present invention. Cleaner assembly 138 includes the auger 126, the drive shaft 130, and the waste toner storage container 140. The auger 126 extends between a proximal end 142 and a distal end 144. The drive shaft 130 has a drive end 146 and an undriven end 148. The proximal end 142 of the auger 126 is adjacent to the driven end 146 of the drive shaft 130. The undriven end 148 of the drive shaft 130 terminates before the distal end 144 of the auger 126 enters into the waste toner storage container 140 through an inlet 160 (FIG. 6). A curved portion of the auger 126 follows a tube 150, mounted inside the waste toner storage container 140, with little resistance to bending. The distal end 144 of the auger 126 is disposed within the tube 150. The tube 150 extends between a first end 156 (FIG. 6) and a second end 152. The first end 156 of the tube 150 is attached to the waste toner storage container 140 and the second end 152 of the tube 150 extends to a point vertically above the inlet 160 (FIG. 6) so that the waste toner exiting the tube 150 falls from an upper portion of waste toner storage container 140 towards the bottom, utilizing more space inside the waste toner storage container 140.

As shown in FIG. 5, both ends of the tube 150 reside inside the waste toner storage container 140. The shape of the tube 150 can vary depending on the application and the particular shape of waste toner storage container 140. In an exemplary embodiment, tube 150 is curved in a direction to effectively allow the auger 126 to fill the space inside the waste toner storage container 140 with the remaining toner. The mounting location of the tube 150 coincides with a center point of the exit portion of channel 124 into the waste toner storage container 140 so that the auger 126 extends from channel 124 to tube 150 with a substantially smooth transition.

According to one embodiment of the present invention, the tube 150 can be oriented to point the auger 126 towards the hardest to fill area of the waste toner storage container 140. This reduces pressure on the auger 126 and the drive mechanism 128 by directing the waste toner towards the area inside the waste toner storage container 140 that is farthest away from the entry point of auger 126. As shown in FIG. 5, the auger 126 points towards a top corner of the waste toner storage container 140, where the incoming waste toner will encounter less flow resistance than if it were directed straight into the waste toner storage container 140 as observed in prior waste toner collection systems.

FIG. 6 illustrates another perspective view of the waste toner storage container 140 according to an exemplary embodiment of the present invention. The waste toner storage container 140 includes a housing 154 that encloses the tube 150. Further, the tube 150 includes perforations (or passages) 158 disposed along its length and periphery.

Figure 7A:
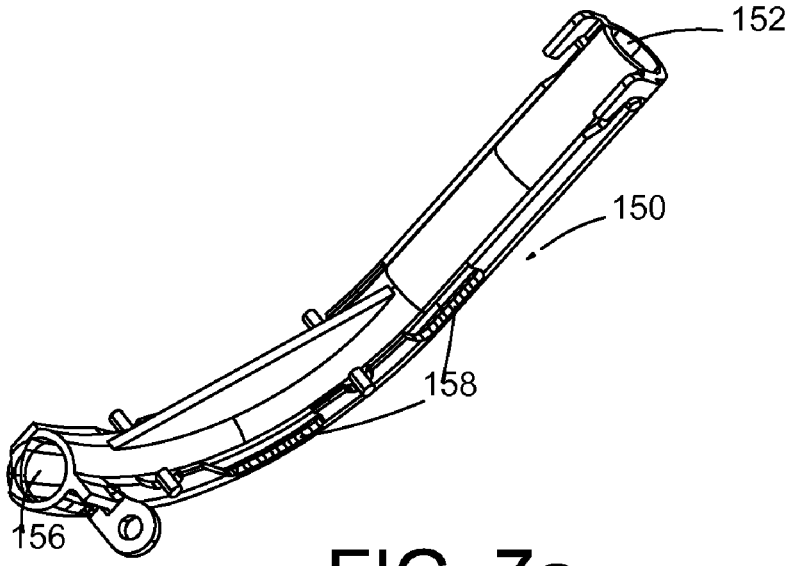
FIGS. 7*a* and 7*b* are isometric views of one embodiment of a tube member of the waste toner storage container of FIG. 5.
Figure 7B:
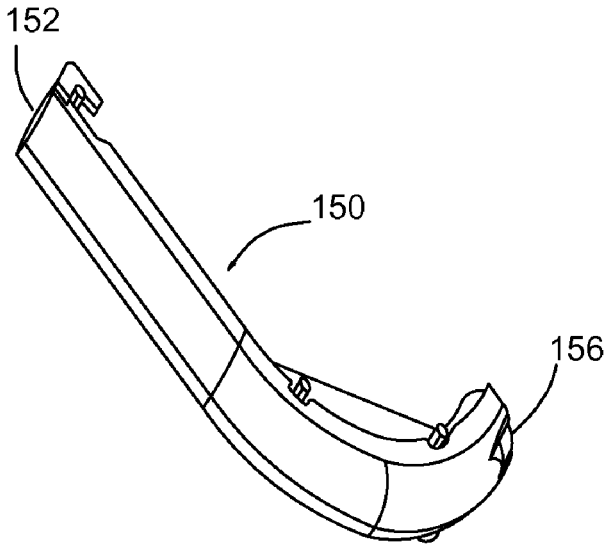

FIGS. 7*a* and 7*b* illustrate isometric views of the tube 150 as an example of one embodiment according to the present invention. The tube 150 is formed by two half portions made from injection molded plastic. The tube 150 may have features on each side that hold the two halves together to form an enclosure around the auger 126. However, it is understood there are a number of methods by which the tube 150 can be formed, including the use of metal tubing or even blow-molded plastic. As can be seen in FIG. 7*a*, the tube 150 includes the perforations 158 along its length and periphery. The perforations 158 in the tube 150 may be placed according to the shape of the waste toner storage container 140 (FIG. 5) it is designed to fill. Changing the size, shape, and location of the perforations 158 will change the fill pattern of the waste toner within waste storage container 140. In one of the embodiments, the perforations 158 in the tube 150 may extend around its entire periphery and along its length. In another embodiment, one or two perforations may be needed in a particular location to achieve the desired result. It is understood that the perforations 158 in the tube 150 may be any aperture and/or through-hole defined along the body of the tube 150 which are separate and distinct from the opening at each end of the tube 150.

Figure 8:
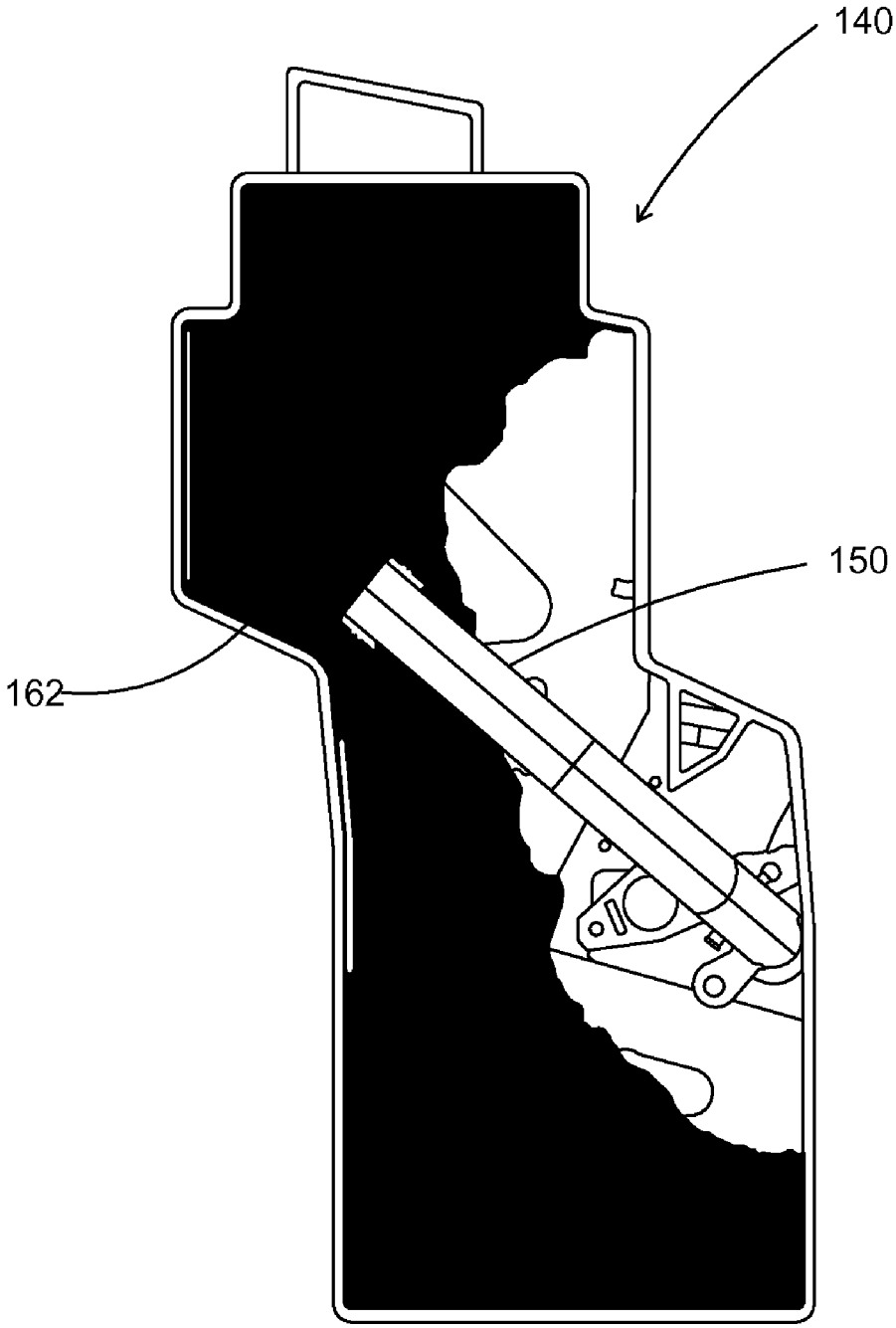
FIG. 8 illustrates waste toner distribution for the waste toner storage container according to an exemplary embodiment of the present invention.

FIG. 8 illustrates a fill pattern of waste toner within waste storage container 140 with the tube 150 being without any perforations 158. The tube 150 does not allow the auger 126 disposed within the tube 150 to substantially evenly fill waste toner storage container 140. By directing the end of the auger 126 towards an upper portion of the tube 150, the uppermost corners of the waste toner storage container 140 can be effectively filled. However, this may create a barrier for substantially filling a bottom portion of the waste toner storage container 140. As mentioned, the waste toner 162 can create pressure around the entry point of the auger 126 into the waste toner storage container 140 when no tube 150 is present. As can be seen, when the tube 150 without perforations is directed towards the top of waste toner storage container 140, a relatively high pressurized area of the waste toner 162 is created in the top portion of the waste toner storage container 140, despite there being substantially unfilled areas of the waste toner storage container 140 towards the bottom. After a sufficient amount of the waste toner 162 has been delivered to the upper portion of the waste toner storage container 140, the waste toner 162 hangs in the top half of the waste toner storage container 140 without falling to the bottom thereof. Because the waste toner 162 has a tendency to stick together, pressure surrounding the end of the auger 126 builds up in the top corner of the waste toner storage container 140. This pressure surrounding the end of the auger 126 can create enough resistance to the auger 126 rotation to cause failure of the drive mechanism 128 even before other portions of the waste toner storage container 140 have been filled.

Figure 9A:
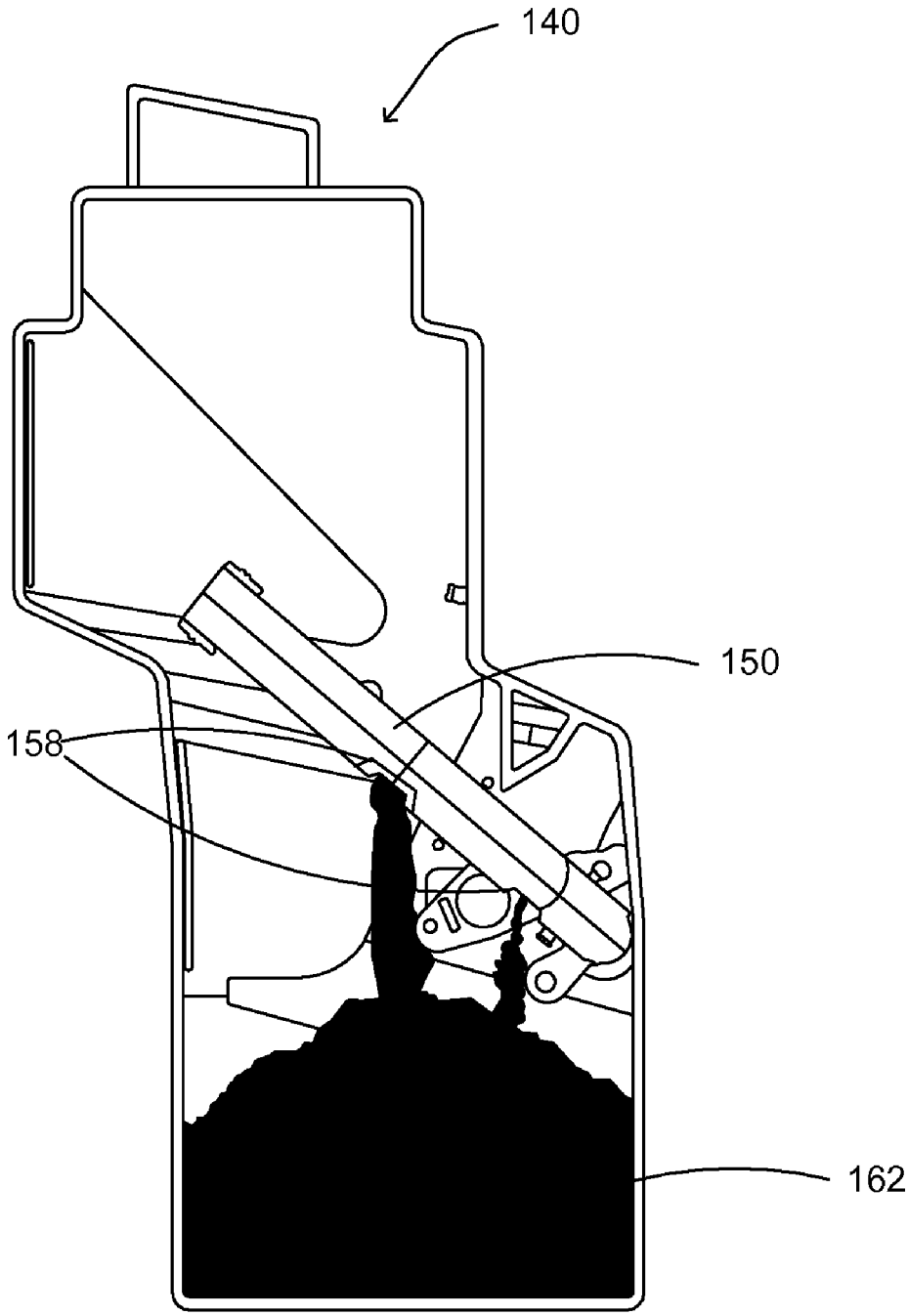
FIGS. 9*a*-9*c* illustrate waste toner distribution at various stages of a fill cycle according to an exemplary embodiment of the present invention.
Figure 9B:
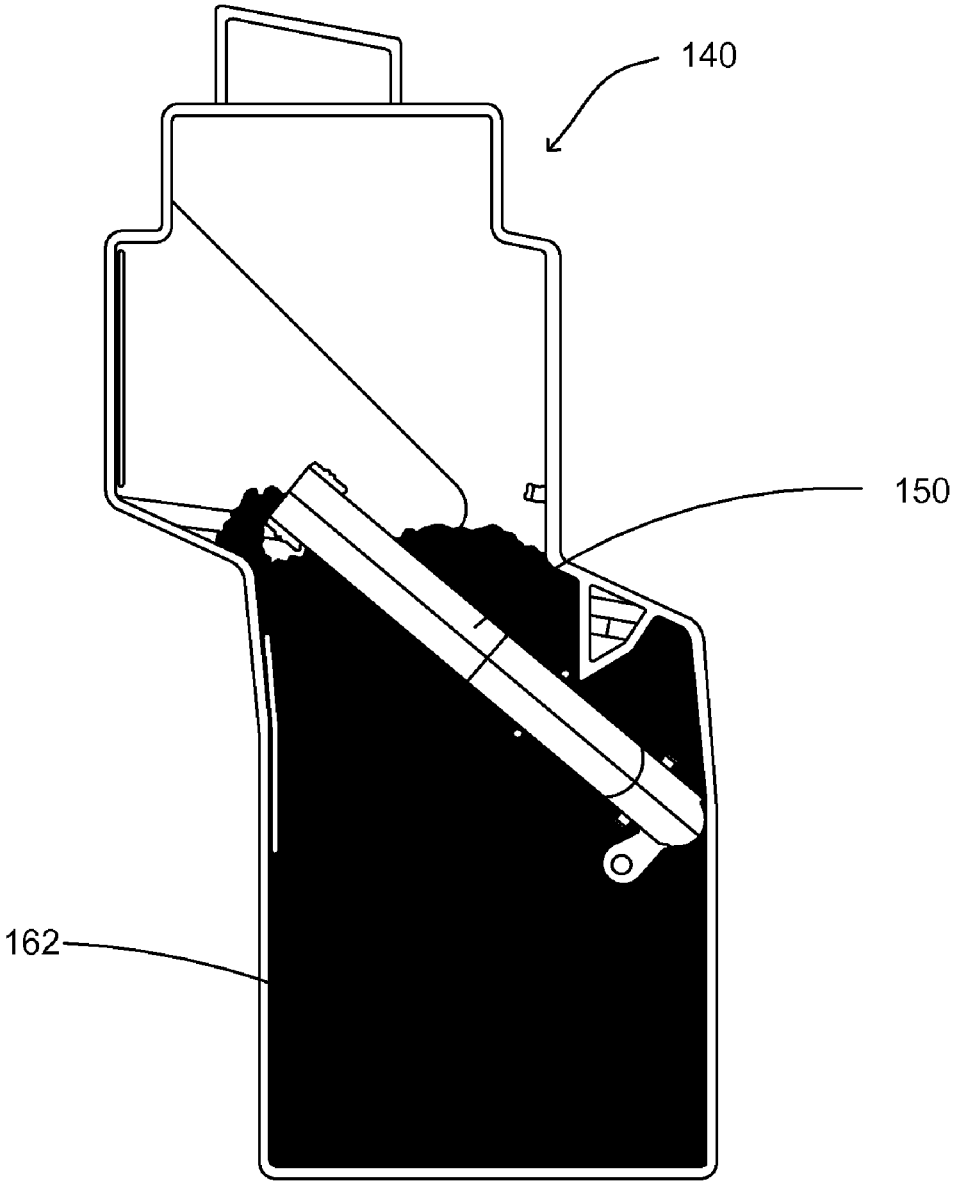
Figure 9C:
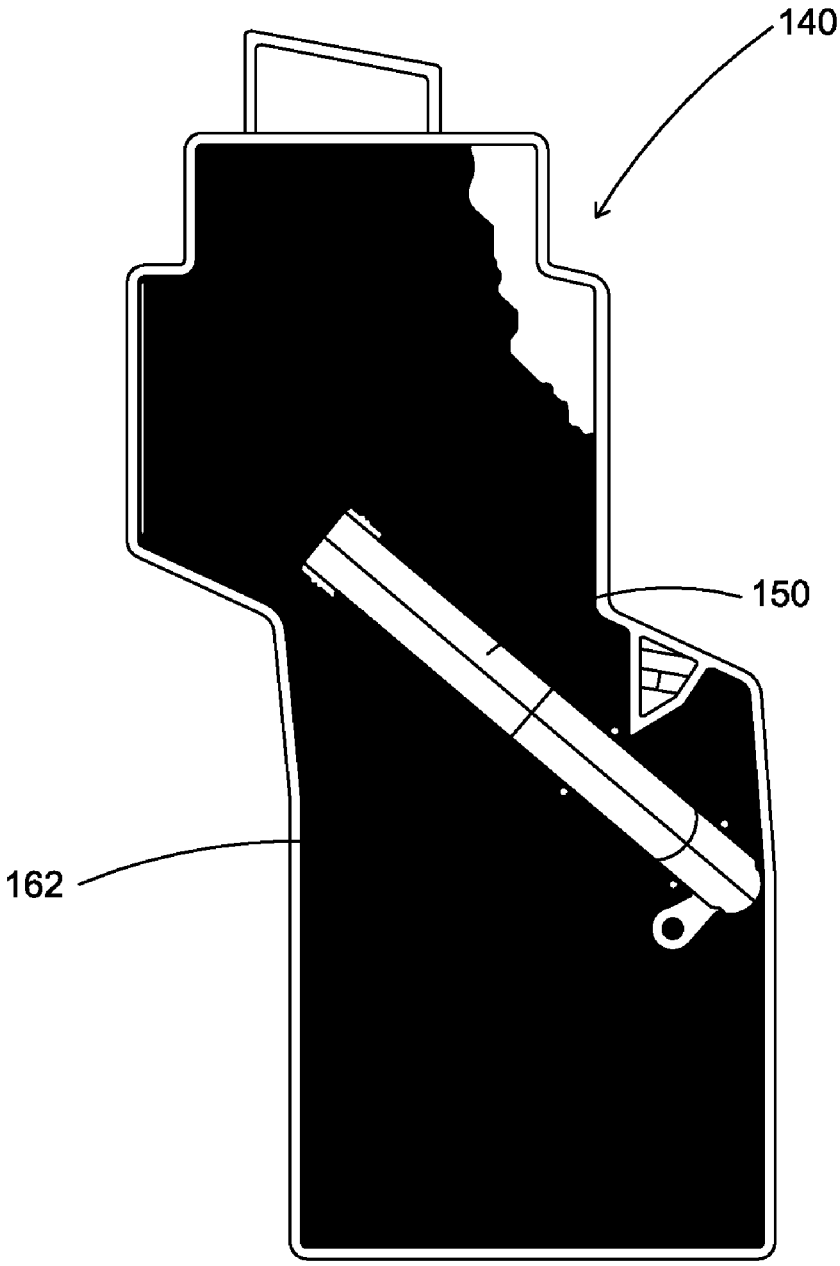

FIGS. 9*a*, 9*b*, and 9*c* illustrate a waste toner fill pattern with tube 150 having perforations 158 as described above. FIG. 9*a* illustrates the toner distribution pattern at about the beginning of the waste toner fill cycle. FIG. 9*b* illustrates waste toner distribution at about a mid point in the fill cycle, and FIG. 9*c* illustrates the waste toner distribution near an end of the fill cycle. By creating the perforations 158 along body of the tube 150, the waste toner 162 is allowed to move from inside the body of the tube 150 to the waste toner storage container 140 to fill major portions of the waste toner storage container 140 as the tube 150 is pointing upwards towards a top of the waste toner storage container 140.

As shown in FIG. 9*a*, near the beginning of the fill cycle of the waste toner storage container 140 the perforations 158 in the tube 150 allow the waste toner to escape out of the tube 150 before the waste toner reaches the end 152 of the tube 150. The waste toner passes through the perforations 158 until the level of the waste toner 162 inside the waste toner storage container 140 reaches the perforations 158. When the waste toner level reaches and surrounds a perforation 158, the push of the auger 126 works to lightly compact the waste toner 162 around the perforation 158 thereby resulting in the perforation 158 effectively closing and being blocked. At this point, the waste toner 162 can no longer pass through the perforation 158. The tube 150 thus functions as if the blocked perforation 158 does not exist. Waste toner moved by auger 126 continues to pass through the unblocked perforations 158 having higher elevations until the toner level rises to effectively close them. Eventually, the waste toner level in waste storage container 140 rises until all perforations 158 are blocked, thereby causing auger 126 to move waste toner from tube 150 through end 152 of tube 150 (FIG. 9*b*). Waste toner subsequently collected continues to be discharged from tube 150 through end 152 until the upper portion of waste storage container 140 is substantially filled (FIG. 9*c*). By initially filling the lower portions of waste storage container 140 using perforations 158 and then filling the upper portions of waste storage container 140 by having end 152 of tube 150 disposed in the upper portions and pointing towards a top of waste storage container 140, waste toner is efficiently stored.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A cleaner assembly for moving waste toner, comprising:

an auger having a substantially helical configuration; and a waste toner storage container having an inlet and a tube mounted within the waste storage container, the tube including a first open end coupled to the inlet and wherein at least a portion of the auger is disposed within the tube, wherein the tube includes a second open end that extends within the waste toner storage container to a point vertically above the inlet for allowing the waste toner to exit the tube.

2. The cleaner assembly of claim 1, wherein the tube includes a plurality of perforations along a length thereof for allowing the waste toner to exit the tube.

3. The cleaner assembly of claim 1, wherein the tube is positioned within the waste toner storage container such that the second open end of the tube is in an upper half of the waste toner storage container.

4. The cleaner assembly of claim 3, wherein the first open end of the tube is positioned in a lower half of the waste toner storage container.

5. The cleaner assembly of claim 1, wherein the tube has a curved shape and the auger is curved to follow the curved shape of the tube.

6. A cartridge for an imaging device, comprising:

an auger;

a waste toner container having an inlet; and a tube mounted within the waste toner container having a first open end coupled to the inlet and wherein at least a portion of the auger is disposed within the tube, wherein a second open end of the tube is disposed within the waste toner container at a point vertically above the inlet for allowing the waste toner to exit the tube.

7. The cartridge of claim 6, wherein the tube includes one or more passages defined along the tube for allowing the waste toner to exit the tube for storage within the waste toner storage container.

8. The cartridge of claim 6, wherein at least a portion of the tube is curved.

9. The cartridge of claim 8, wherein the auger is curved to follow the curve of the tube.

10. The cartridge of claim 6, wherein the second open end of the tube is disposed in an upper portion of the waste toner container.

11. The cartridge of claim 10, wherein the first open end of the tube is located at a middle portion of the waste toner container.

12. A cartridge for an imaging apparatus comprising:

a photoconductive drum;

a channel for collecting waste toner cleaned off the photoconductive drum, the channel disposed in proximity with the photoconductive drum;

an auger having a first portion positioned in the channel to move the collected waste toner; and a waste toner storage container comprising:

a housing having an inlet to receive the waste toner; and a tube mounted within the housing having a first open end coupled to the inlet and wherein a second portion of the auger is disposed within the tube, wherein a second open end of the tube extends to a point vertically above the inlet in an upper portion of the housing.

13. The cartridge of claim 12, wherein the tube includes a plurality of perforations for allowing the waste toner to exit the tube for storage within the housing.

14. The cartridge of claim 12, wherein at least a portion of the tube is curved.

* * * * *